United States Patent [19]

Allain, deceased

[11] 4,333,654

[45] Jun. 8, 1982

[54] GAME

[75] Inventor: John C. Allain, deceased, late of New Iberia, La., Regina Gonsoulin Allain, administratrix

[73] Assignees: Regina Gonsoulin Allain; John Russell Allain; Timothy Stephen Allain; Christina Rita Allain, all of New Iberia, La.; part interest to each

[21] Appl. No.: 54,682

[22] Filed: Jul. 5, 1979

[51] Int. Cl.[3] ..... A63F 3/00

[52] U.S. Cl. ..... 273/241; 273/242

[58] Field of Search ..... 273/241, 242, 262, 263, 273/267, 258

[56] References Cited

U.S. PATENT DOCUMENTS

| | | | |
|---|---|---|---|
| 610,534 | 9/1898 | Hellier | 273/258 |
| 3,656,755 | 4/1972 | Thompson | 273/241 |
| 3,784,205 | 1/1974 | Cross, Jr. | 273/242 |
| 4,171,814 | 10/1979 | Tamano | 273/243 |

FOREIGN PATENT DOCUMENTS

| | | | |
|---|---|---|---|
| 2550336 | 5/1977 | Fed. Rep. of Germany | 273/241 |
| 1258246 | 12/1971 | United Kingdom | 273/267 |

OTHER PUBLICATIONS

*The Way to Play,* ©1975 to Diagram Visual Information Ltd., Ed. R. Midgley, p. 41.

*Primary Examiner*—Richard C. Pinkham
*Assistant Examiner*—Scott L. Brown
*Attorney, Agent, or Firm*—Carl B. Fox, Jr.

[57] ABSTRACT

Game methods and apparatus, the apparatus comprising a single-level or multi-level game board, and a suitable number of distinguishable markers for plural players. Each player commences play with a predetermined number of markers, arranged on the single or multiple game board levels. The players play repeatedly in predetermined order, each player moving a single marker to any unoccupied space on the game board apparatus, each board having plural aligned spaces not less than three in number in each of perpendicular directions. A board level is eliminated as to any player when that player has no more than three markers remaining on that board level, and a board level is eliminated as to all players when only one player has more than three markers remaining on that level. The last player having more than three markers remaining on the last active board level is the winner of the game. Captures of another player's markers is accomplished by surrounding of the captured marker in any of specified manners. A captured marker is removed from play permanently.

1 Claim, 9 Drawing Figures

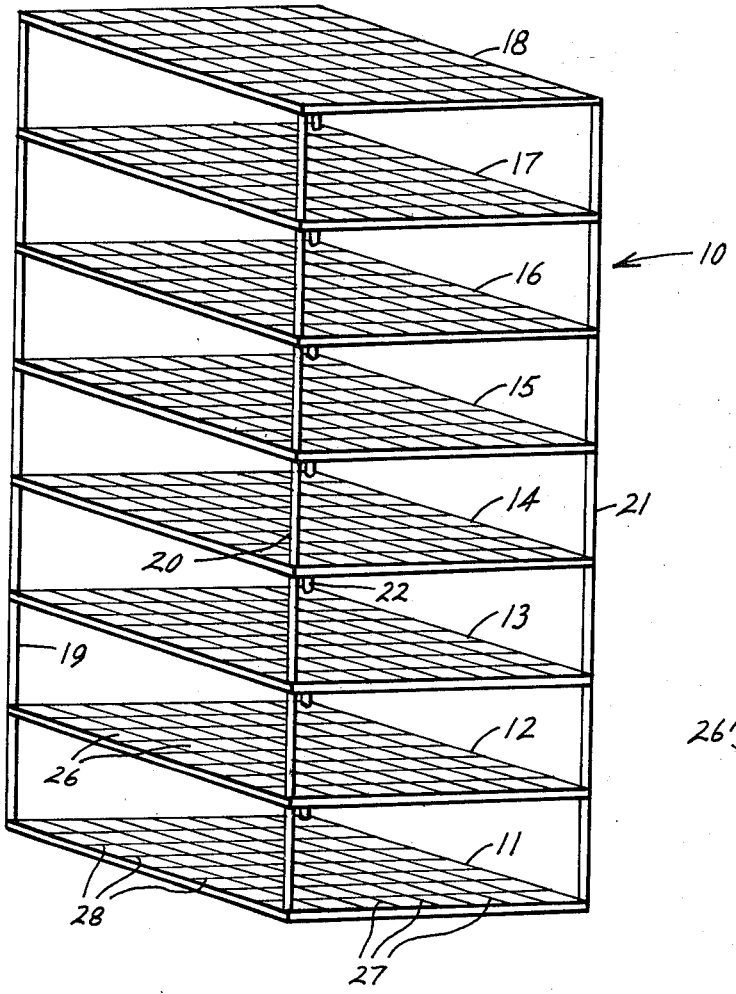
Fig. 1
Fig. 2
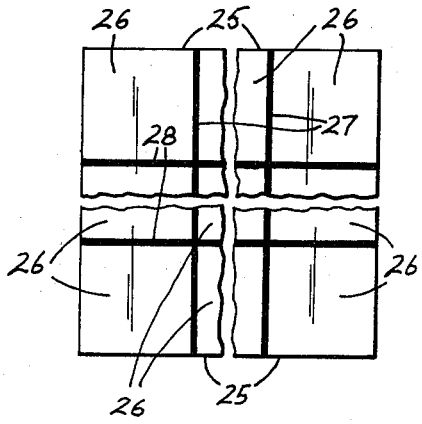
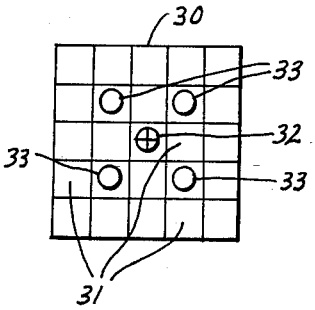
Fig. 3
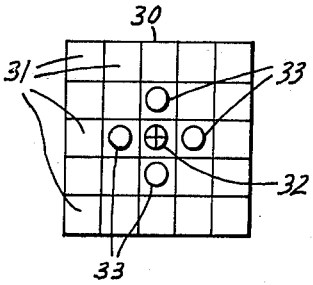
Fig. 4
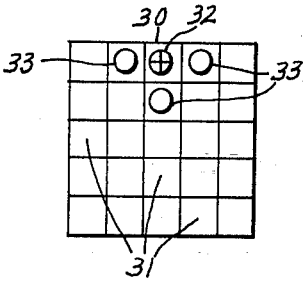
Fig. 5

GAME

BACKGROUND OF THE INVENTION

Board games are conventionally played on a flat, single level game board. Pieces or markers "taken" during the course of a game are conventionally taken by a capturing piece landing on the space occupied by the taken or captured piece. According to this invention, a game of added interest and of additional requirements for skillful play is created, wherein play may be on multi-level game board apparatus as well as on single-level game board apparatus, and wherein capturing or taking of an opponent's piece or marker is accomplished by surrounding of the captured or taken piece or marker.

SUMMARY OF THE INVENTION

The game provided by the invention, to be known as "Neckers", may be played on either a single-level or a multi-level game board apparatus. Pieces or markers of an opponent are taken or captured, for removal from the game board, by surrounding of the piece or marker. When a multi-level game board is used, levels are removed from play as the game proceeds, so that the final play is on a single-level game board surface. Pieces are moved by the players in rotation, each player in turn moving a piece from its former location to any unoccupied space, seeking to surround a piece of an opponent player and seeking to prevent surrounding of his own pieces by the pieces of the opponent or opponents.

Each player initially has the same number of markers or pieces. When a multi-level game board is used, each player has the same number of pieces on each level of the game board. Markers of the different players are distinguished by different colors, or by other suitable means. The number of markers used may be varied, and the number of spaces on each game board level may be varied, without departing from the concept of the game.

A principal object of the invention is to provide methods for play of a game. Another object is to provide a game which may be played on a single-level game board or on a multi-level game board. A further object of the invention is to provide such a game and methods for play of the game which provides interest and entertainment during play, and which requires a certain level of skill. Yet another object of the invention is to provide such a game and methods for play of the game for which the level of skill required for appropriate play may be varied, so that the game may be adapted to players of all ages and skill levels. Another object of the invention is to provide a game which may be played on other game board equipment, such as on a checker board or on a chess board, using the respective markers or pieces.

Other objects and advantages of the invention will appear from the following detailed description thereof, reference being made to the accompanying drawings.

BRIEF DESCRIPTIONS OF THE DRAWINGS

FIG. 1 is an upper perspective view of a preferred form of game board apparatus, same being a multi-level or tiered form of game board apparatus.

FIG. 2 is an upper elevation of a single-layer game board apparatus.

FIGS. 3–5 are upper elevations of a single game board layer or surface, showing pieces or markers thereon to illustrate the method of play of the game.

DESCRIPTIONS OF THE PREFERRED EMBODIMENTS

Figure 6:
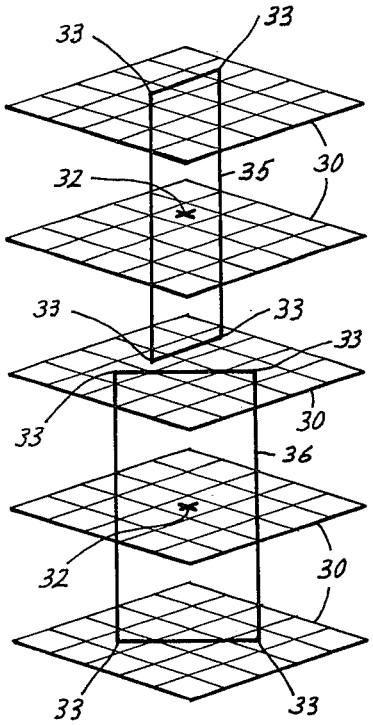
FIGS. 6–8 are schematic illustrations, showing in perspective different phases of the methods according to the invention.

Referring now to the drawings in detail, and first to FIG. 1, a multi-level or multi-tiered game board apparatus according to the invention is shown. The apparatus 10 includes eight game board elements 11–18 supported parallelly apart by corner posts 19–22. The game board elements are identical, and are spaced equal distances apart vertically by the posts 19–22.

Each game board element 11–18 consists of a flat board, which may be formed of any suitable material such as wood, fibre board, cardboard, plastic, or the like. The elements should be rigid so that they do not sag when supported by the posts 19–22. The elements may also be formed of metal. Preferably, for multi-level game board apparatuses, elements 11–18 are formed of transparent plastic, so that lower levels or tiers may be seen through upper levels or tiers.

The posts 19–22 may each be a continuous post extending from the top to the bottom of the apparatus, and bonded to the elements 11–18 or affixed thereto in other suitable manner. Alternatively, the posts 19–22 may be segmented, with each segment extending between adjacent elements 11–18, and affixed thereto by bonding or by suitable fastening elements, these expedients being well known in the art and not requiring further explanation or illustration.

While FIG. 1 shows an apparatus having eight game board elements 11–18, the apparatus for multi-level play may have three or more game board elements. An apparatus having five game board elements is considered optimum.

Referring now to FIG. 2 of the drawings, there is shown a single-level game board apparatus, consisting of a single element such as one of elements 11–18 shown in FIG. 1. The broken apart showing of the game board element 25 in FIG. 2 indicates that the number of square shaped subdivisions 26 may be varied in number. For example, the number of squares may be any number not less than three, it being preferred that the number of squares in each direction is the same, but it being possible that the number of squares in the two mutually perpendicular directions are different. This is also true for the game board elements 11–18 of FIG. 1, the upper surfaces of which may be subdivided into squares or spaces not less than three in each perpendicular direction, it being preferred that the number of squares in each perpendicular direction be the same, but it being recognized that the numbers may be the same or different. In FIG. 1, eight spaces in each direction are shown, this being preferred for apparatuses having any number of playing levels. The spaces 26 may be rectangular rather than square, but square shapes for the spaces are preferred.

Spaces 26 are defined by parallel lines 27 in one direction, and parallel lines 28 perpendicular to lines 27. The lines may be printed on the game board surfaces, or formed in other suitable manner, such as by painting, stamping, embossing, or the like. Other game board expedients known in the art may be employed. Alternate squares may be of different colors.

FIGS. 3–5 illustrate three manners of capture of an opponent's piece or marker on a game board surface. The game board surface 30 may be the upper surface of either a game board element 11–18 or a game board element 25, the upper surfaces of which may be identical. Surface 30 has five squares or spaces 31 in each of the perpendicular directions. Marker 32 is the marker of an opponent. Markers 33 are markers of the player making the capture. In FIG. 3, the capture is made by four markers 33 disposed in a square pattern about the captured marker 32, as shown. In FIG. 4, the capture is made by four markers 33 disposed in a diamond pattern about the captured marker 32, as shown. In FIG. 5, the capture is made by three markers 33 disposed in an incomplete diamond pattern about the captured marker 32, as shown. Capture by an incomplete square pattern is not permitted. The above methods of capture are employed on a single game board surface, as when only a single game board is used, or on a single game board of a multi-level game board apparatus.

Figure 7:
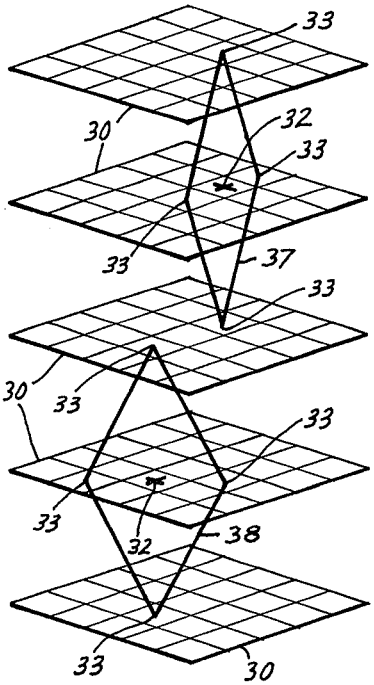
Figure 8:
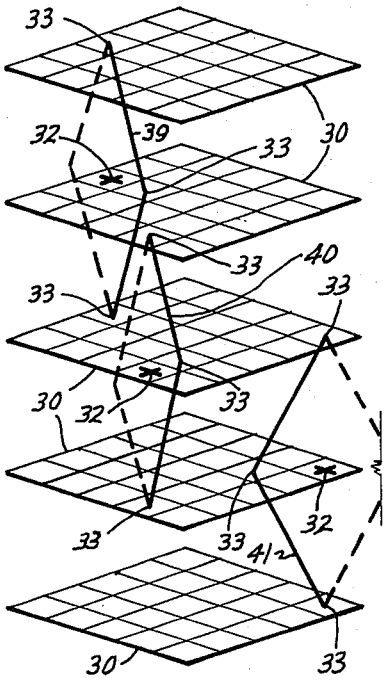

Methods for capture of an opponent's piece or marker are illustrated in FIGS. 6–8. In FIG. 6, two forms of capture are shown. Upper square or rectangle 35 represents four markers 33 disposed at the corners of the square or rectangle. The captured marker 32 is located at the cross at the center of the square or rectangle. Square 35 is disposed perpendicular to opposite sides of the boards, which are elements of a multi-level game apparatus. Lower square or rectangle 36 represents four markers 33 making a capture of marker 32 at the center of the square or rectangle. Square or rectangle 36 is disposed diagonally on the boards, as shown. Captures of the types represented by squares or rectangles 35, 36 may be made at any locations of the game boards where adequate squares for occupancy by the necessary markers are present.

Referring to FIG. 7 of the drawings, capture of the upper marker 32 is made by four markers 33 at the four corners of diamond 37, and capture of the lower marker 32 is made by four markers 33 at the four corners of diamond 38. Diamond 37 is disposed perpendicular to opposite sides of the board. Diamond 38 is disposed diagonally of the board. Captures of the types represented by diamonds 37, 38 may be made at any locations of the game boards where adequate squares for occupancy by the necessary markers are present.

FIG. 8 shows three captures by partial diamond arrangements 39, 40, 41 of three markers 33 each, disposed about a central captured marker 32, as shown. Partial diamond arrangements 39, 40, 41 may be made at any locations of the game board where adequate squares for occupancy by the necessary markers are present.

All of the captures of FIGS. 6–8 involve capturing markers at three game board levels, with the captured piece being on the central level. Captures such as shown in FIGS. 6–8 cannot be made when less than three game board elements are used.

Each game board surface, as has been earlier stated, may have three or more squares or spaces in mutually perpendicular directions. Eight squares or spaces in each direction is considered optimum. Markers are provided for each player, the markers of one player being distinguishable from the markers of each other player.

The number of markers or pieces which each player has may be varied somewhat. Preferably, each player will have the number of markers equal to the number of squares along one side of each game board surface. If the game board has eight squares along each side, then each player will have eight markers. For multi-level game apparatuses, each player will have this number of markers for each level. For example, if the board has six squares in each direction, and there are five levels, then each player will preferably have thirty markers, six initially placed on each level. If the board has eight squares in each direction, and there are eight levels, then each player will preferably have sixty-four markers, eight initially placed on each level.

The markers are initially placed, preferably, along the board sides. Other initial arrangements may be agreed upon by the players. No initial capture arrangements should exist; if they do, they are not to be effective, and only later captures are recognized.

The players play in turn, in fixed order selected by chance, as by rolling dice or drawing slips from a receptacle, or the like. After all players have had a turn, play is continued by play by each player in turn, repeatedly in the same order. At each turn, a player moves one piece or marker to any unoccupied space on any game board level. A player may not pass, and must move a marker each time the player's turn occurs.

Each player endeavors to move his markers to positions resulting in capture of a marker of another player. Each captured marker is removed permanently from the board. When the number of markers on any level is reduced to three for any player, those three markers are removed from the board, and the player whose markers are thus reduced to zero for any level can no longer play on that level. When only one player has markers on any level, that player moves his markers from that level to any available open spaces on any other level at that time, whether it is his turn to play or not. Such marker movements are not counted as a turn but the player moving may capture opponent's markers by these movements, and the player gets his turn in regular order in which he moves one marker in the manner already described.

A player is eliminated from the game, and loses, when he has no more than three markers on the last level on which he is entitled to play. When only one player remains, that player is the winner of the game. The last portion of play will, of course, be on a single game board element, as when multi-level game board equipment is used, the levels will be eliminated one after another until only one level remains.

The same rules apply to multi-level and single-level games. Multi-level captures may be made only when multi-level apparatus is used. When a level of a multi-level apparatus is eliminated from play, multi-level captures are made as though the eliminated level were not present, levels having an eliminated level therebetween being considered as adjacent levels.

Figure 9:
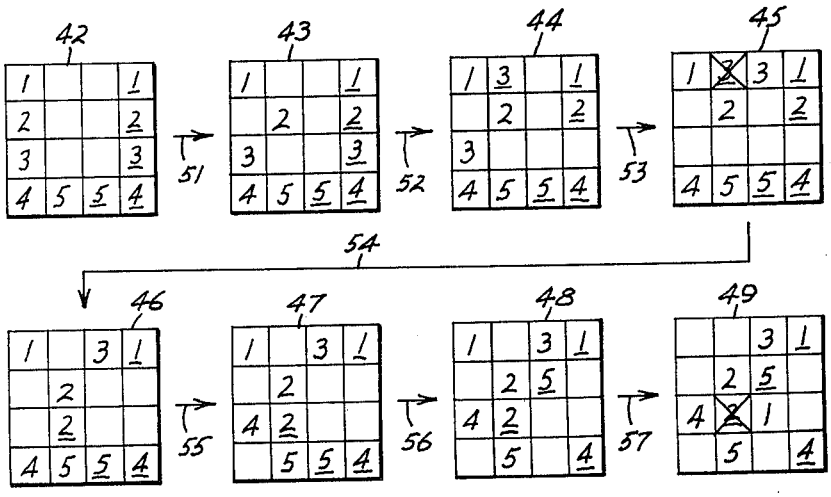
FIG. 9 is a schematic illustration showing the complete play of a game according to the invention.

Play of a simple game between two players on a single-level apparatus is indicated in FIG. 9 of the drawings. Commencing with the upper lefthand illustration of the board referred to by reference numeral 42, play proceeds through illustrations 43–49 as indicated by arrows 51–57. The board has four spaces in each direction, and each player has five pieces or markers. One players's markers are indicated by numerals "1", "2", "3", "4", and "5". The other player's markers are indicated by underlined numerals "1", "2", "3", "4", and "5". The markers are initially arranged as shown in illustration 42. The first player, in his first turn, moves his marker "2" to the position shown in illustration 43. The second player, in his first turn, moves his marker "3" to the position shown in illustration 44. The first player, in his second turn, moves his marker "3" to the position shown in illustration 45, capturing the second player's marker "3", as indicated by the superposed "X", that marker then being removed from play. The second player, in his second turn, moves his marker "2" to the position shown in illustration 46. The first player, in his third turn, moves his marker "4" to the position shown in illustration 47. The second player, in his third turn, moves his marker "5" to the position shown in illustration 48. The first player, in his fourth turn, moves his marker "1" to the position shown in illustration 49, capturing the second player's marker "2", as indicated by the superposed "X", that marker being removed from play. The removal of the second player's marker "2" from the game reduces the second player's markers to three in number, so that the second player must then remove all of his markers from the board, and the game is terminated, the first player being the winner.

The game described in connection with FIG. 9 is simplistic, as a second player of any real ability would not allow capture of his markers so easily, but the game as illustrated and described exemplifies the procedures for play of the game. On a multi-level apparatus, the play would proceed as described, but with marker movements from any active play level to any other active play being possible, and with captures extending over plural play levels being possible. As stated, in multi-level play, the play levels are eliminated one-by-one as the game proceeds, until only a single play level remains for the final play.

The maximum number of players who can play in a given game is limited only by overcrowding of the board spaces, and very interesting games may be played with almost all of the spaces occupied by markers at the commencement of a game.

Considerable enthusiasm and interest can be expected during play of the game. The game has variations so that it may be played in different manners for different numbers of players and for players of different skills.

The game may be played using a checker board or a chess board, each of which has eight spaces in each perpendicular direction. All or part of a board may be used, i.e. only part of the spaces in each direction may be used, or alternate spaces may be used. Any types of markers may be used, for example, chess markers (valued equally) or checker markers may be used, as well as coins or other suitable markers.

While preferred embodiments of the methods and apparatus have been described and shown in the drawings, many modifications thereof may be made by a person skilled in the art without departing from the spirit of the invention, and it is intended to protect by Letters Patent all forms of the invention falling within the scope of the following claims.

I claim:

1. Method for play of a game on surface means comprising plural coplanar areas disposed side by side in equal parallel rows of at least three areas each in mutually transverse directions on each of a plurality of vertically spaced identical levels of such areas, comprising placing by each player of a distinguishable set of plural markers each on any unoccupied area of any level of such areas, some of said areas remaining unoccupied, each player playing in repetitive sequential turn by moving a single marker of his said set of markers from its prior disposition on an area of a level to any unoccupied other area on the same level or on any other of said levels, capturing and removing a marker of one player when markers of another player become disposed on one or more of said levels to adjacently surround the marker in dispositions in which the surrounding markers define the corners of a rectangle or of a diamond or, at the vertically spaced aligned sides of three of said levels, a half diamond, removing a first player's markers from a level and terminating play by said first player on the said level when said first player has no more than three markers remaining on said level, removing one player's markers from any level when only said one player has more than three markers thereon and placing said one player's markers on an unoccupied area of any one or more of the other said levels, discontinuing play on said any level after said one player's markers have been removed from said any level, continuing play be each player in repetitive turn until only one player having more than three markers remaining on a single level on which play has not been discontinued remains as winner of the game.

* * * * *